US007064486B1

(12) United States Patent
Mabry

(10) Patent No.: US 7,064,486 B1
(45) Date of Patent: Jun. 20, 2006

(54) LOCKING DEVICE FOR MICROCHANNEL PLATE IN IMAGE AMPLIFIER TUBE

(75) Inventor: Thomas Theodore Mabry, Roanoke, VA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 1190 days.

(21) Appl. No.: 09/641,685
(22) Filed: Aug. 18, 2000
(51) Int. Cl.
*H01J 31/50* (2006.01)

(52) U.S. Cl. ..... 313/544; 313/477 R; 313/524
(58) Field of Classification Search ..... 313/370, 313/534, 103 CM, 528, 544, 530, 116, 377, 313/379, 541, 105 CM
See application file for complete search history.

(56) References Cited

U.S. PATENT DOCUMENTS 5,402,034 A 3/1995 Blouch et al.
5,404,072 A * 4/1995 Flanary et al. ..... 313/477 R
6,040,657 A 3/2000 Vrescak et al.

* cited by examiner

*Primary Examiner*—Vip Patel
*Assistant Examiner*—Ken Berck

(57) ABSTRACT

An image intensifier tube comprising a housing which holds a photocathode and a screen, wherein a microchannel plate is supported in a recess in an interior surface of an annular collar which is also held in the housing.

11 Claims, 5 Drawing Sheets

LOCKING DEVICE FOR MICROCHANNEL PLATE IN IMAGE AMPLIFIER TUBE

FIELD OF THE INVENTION

The present invention relates to image intensifier tubes and particularly to an improved device for locking a microchannel plate in a tube housing, which has the effect of shortening the length of the tube.

BACKGROUND OF THE INVENTION

A night vision device amplifies the low levels of light which exist at night to the point where objects become visible to the human eye. The heart of the night vision device is the image intensifier tube, which along with suitable optics make up the night vision device.

The image intensifier tube is comprised of three active components, which are the photocathode, microchannel plate (MCP), and phosphor screen. The photocathode is a photoemissive wafer that is extremely sensitive to low radiation levels of light in the 580–590 nm spectral range. When electromagnetic radiation impinges on the photocathode, the photocathode emits electrons in response.

The MCP is a relatively thin glass plate having input and output planes and an array of microscopic channels through it. An electron impinging on the MCP results in the emission of a number of secondary electrons which, in turn, cause the emission of more secondary electrons. Therefore, each microscopic channel acts as a channel type secondary emission electron multiplier having an electron gain of approximately several hundred. The electron gain is primarily controlled by a potential difference between the input and output planes of the MCP. Consequently, the MCP increases the density of electron emission.

The anode includes an output fiber optic window and a phosphor screen which is formed on a surface of the window. Emitted electrons are accelerated towards the phosphor screen by maintaining the phosphor screen at a higher positive potential than the MCP. The phosphor screen converts the electron emission into an image which is visible to an operator. The tube body housing encompasses all three of the "active" tube elements so a vacuum envelope can be maintained.

As with most electronic devices, it is desired for the image intensifier to be as small as possible. The standard sizes presently have diameters of 18 mm and 25 mm. The miniaturization would be in the form decreasing the length, and weight of the image intensifier tube. The active tube components that can be shortened in length and diameter to any measurable degree would be the photocathode and the phosphor screen. The MCP can be changed in diameter but the length change would be at an absolute minimum.

A problem associated with the present design of image intensifier tubes is that the known methods for holding or locking the MCP in the tube housing add length and diameter to the tube. That is, the fill factor (active components in proportion to support components) is very poor. The two main prior art methods of locking the MCP in the tube housing are described below in connection with FIGS. 1 and 2.

It is thus an object of the present invention to provide an image intensifier tube having a device for locking the MCP which does not add length to the tube and reduces the diameter.

In accordance with an aspect of the invention, this object is accomplished by providing an image intensifier tube comprising a tube housing which holds a photocathode and a screen, wherein a collar is provided which retains an MCP in a recess in an interior surface of the collar.

BRIEF DESCRIPTION OF THE DRAWINGS

The invention will be better understood by referring to the accompanying drawing, wherein.

DETAILED DESCRIPTION OF THE DRAWINGS

Figure 1:
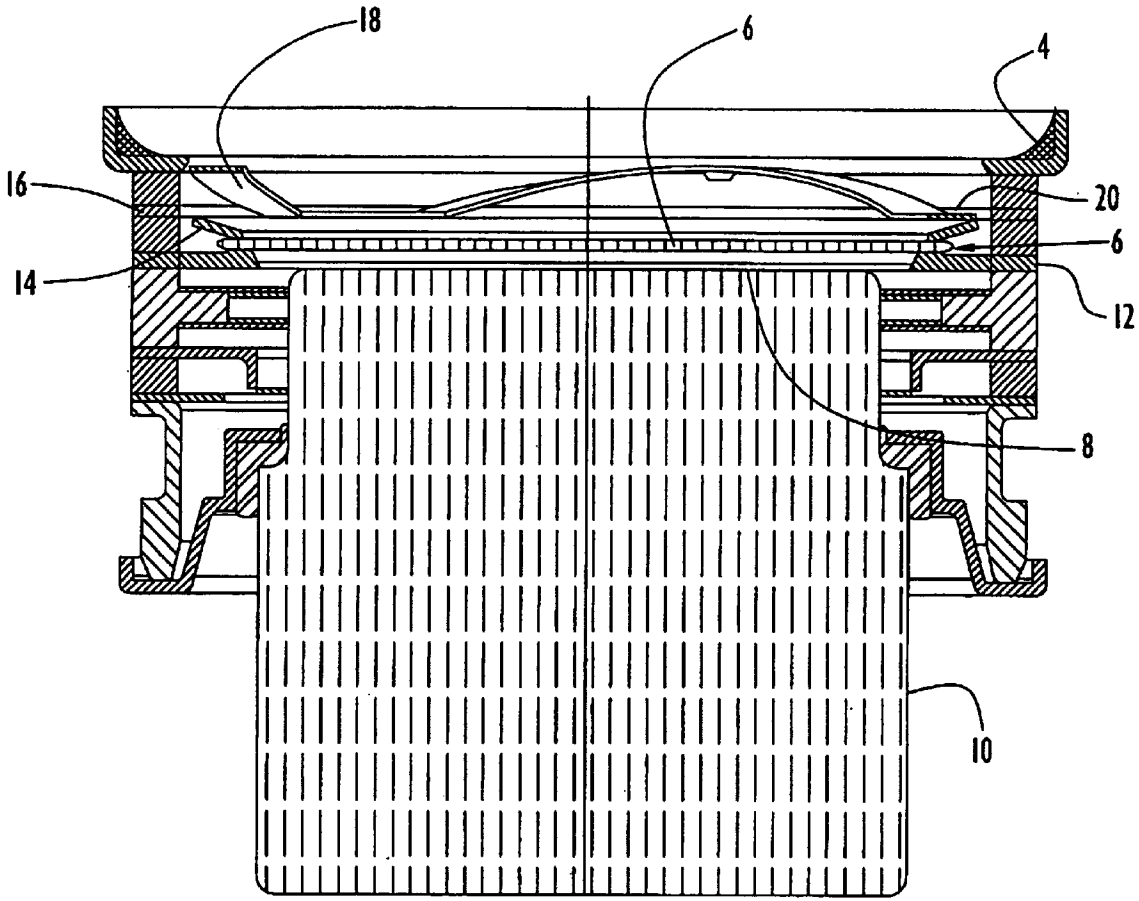
FIG. 1 PRIOR ART
FIG. 1 shows an example of a prior art MCP locking device using a fixed washer and a springy washer.

FIG. 1 shows an image intensifier tube which utilizes a prior art mode of mounting a MCP. Referring to the Figure, the active components of the device are a photocathode (not shown) which fits into receptacle 4, MCP 6, and phosphor screen 8, which feeds visible light into fiber optic 10.

In this prior art mode, the MCP is locked by the combination of a rigid washer and a springy washer. The plate is supported on the bottom by annularly shaped lower MCP support 12 (shown in section) and is locked by the combination of rigid washer 14 which is retained between the MCP and the lower surface of upper MCP support 16, and springy washer 18, which is held under annular tabs 20 of the upper MCP support for creating a downward force.

As can be seen, the prior art washer arrangement adds length to the image intensifier tube.

Figure 2:
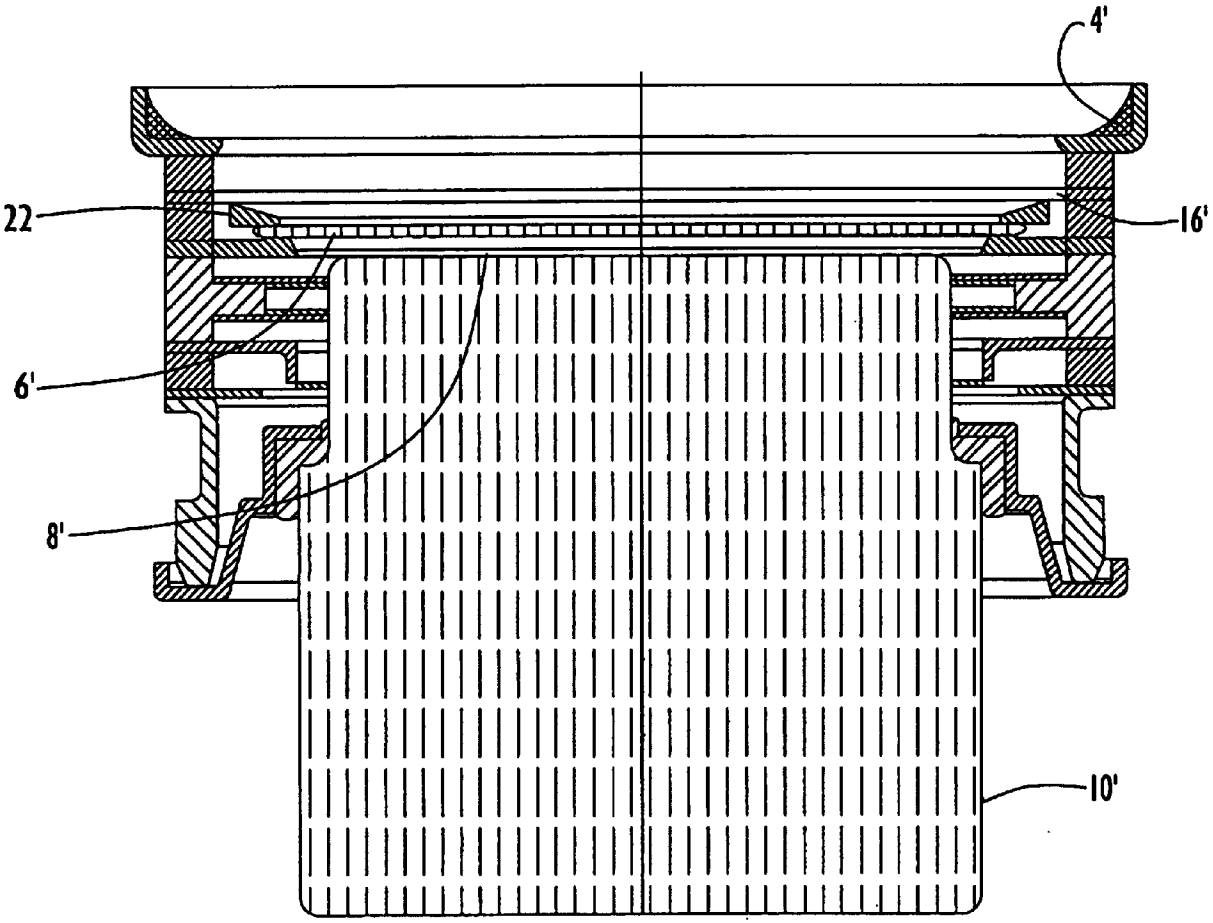
FIG.2 PRIOR ART
FIG. 2 shows an example of a prior art MCP locking device using a snap ring.

FIG. 2 shows an alternative prior art locking scheme, wherein like parts to these of FIG. 1 are identified with primed numbers. In this mode, "snap ring" 22 is compression fit between upper MCP support 16' and the MCP. As can be seen, the snap ring also adds length to the image intensifier tube.

Figure 3:
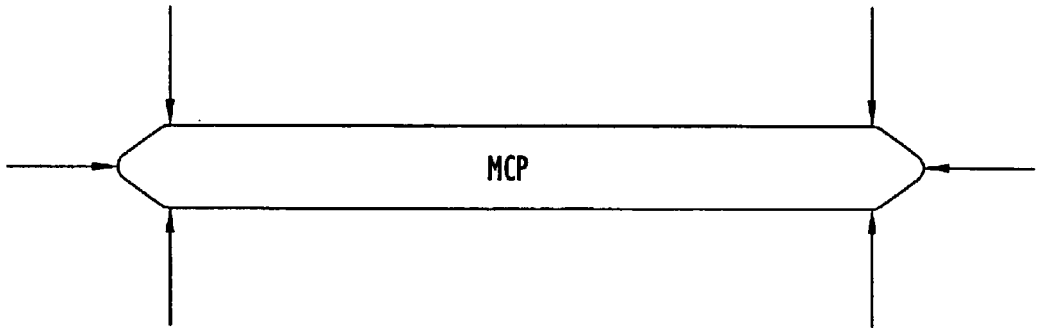
FIG.3 PRIOR ART
FIG. 3 is a free body diagram for an inserted MCP in the prior art.

FIG. 3 is a free body Force diagram for an inserted MCP corresponding to FIGS. 1 and 2. It will be seen that there are downwardly directed forces bearing on the top of the MCP.

Figure 4:
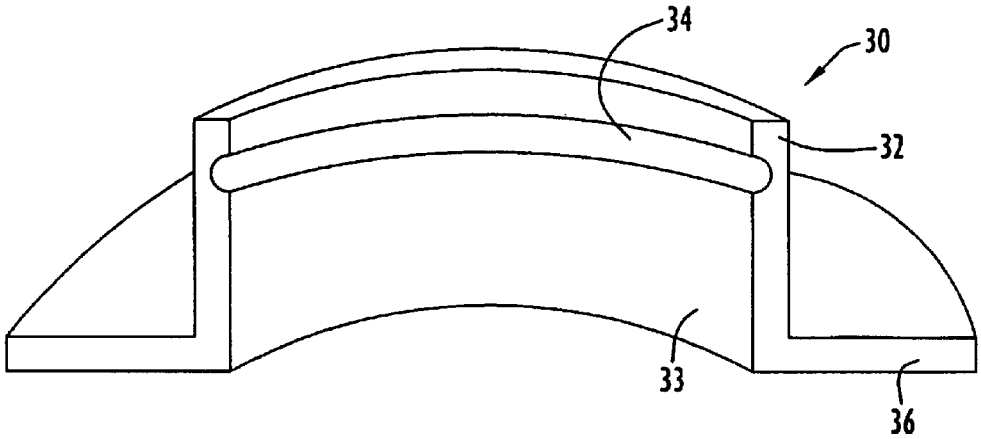
FIG. 4 shows an embodiment of the collar of the present invention in which the MCP is inserted.

FIG. 4 depicts an embodiment of the annular collar 30 of the present invention. For ease of illustration, only half of the entire collar is shown in perspective.

The collar 30 is metallic, and is comprised of cylindrical member 32 and annular base 36. The interior surface 33 of cylindrical member 32 has a recess 34 in which the MCP is held. While the collar base 36 is continuous, cylindrical member 32 has a slice or gap in it, which can extend from the base to the top. The purpose of the slice or gap is to make the collar expandable when pressure is applied, to facilitate the insertion of the MCP in the recess 34.

Figure 5:
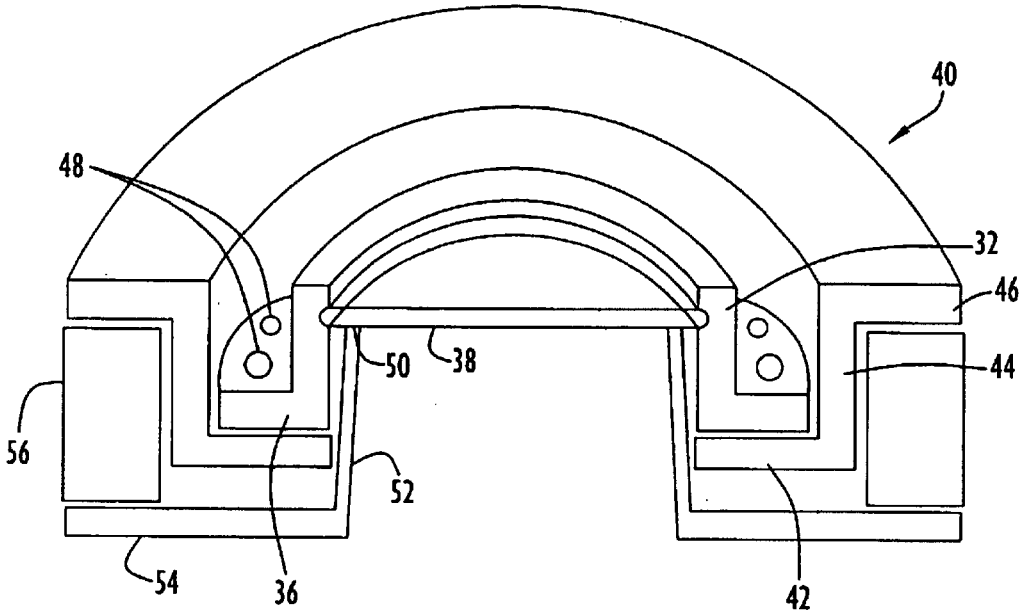
FIG. 5 shows the collar mounted on a peripheral collar retention member.

FIG. 5 shows how the collar is secured to peripheral retention member 40, while also showing the MCP 38 as retained in the collar 32.

Figure 6:
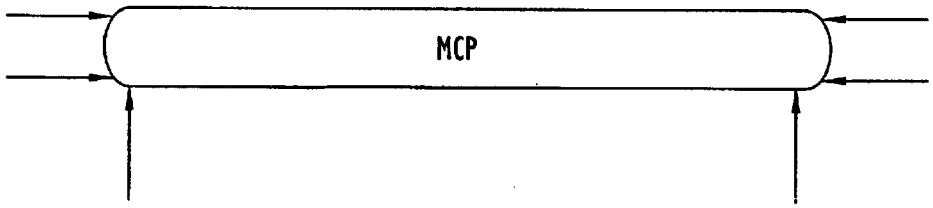
FIG. 6 is free body diagram for an inserted MCP in accordance with the present invention.

FIG. 6 is a free body force diagram for an inserted MCP according to the present invention. When compared to FIG.

3, it will be noted that in FIG. 6 there are upwardly directed forces on the MCP, but no downwardly directed forces.

Figure 7:
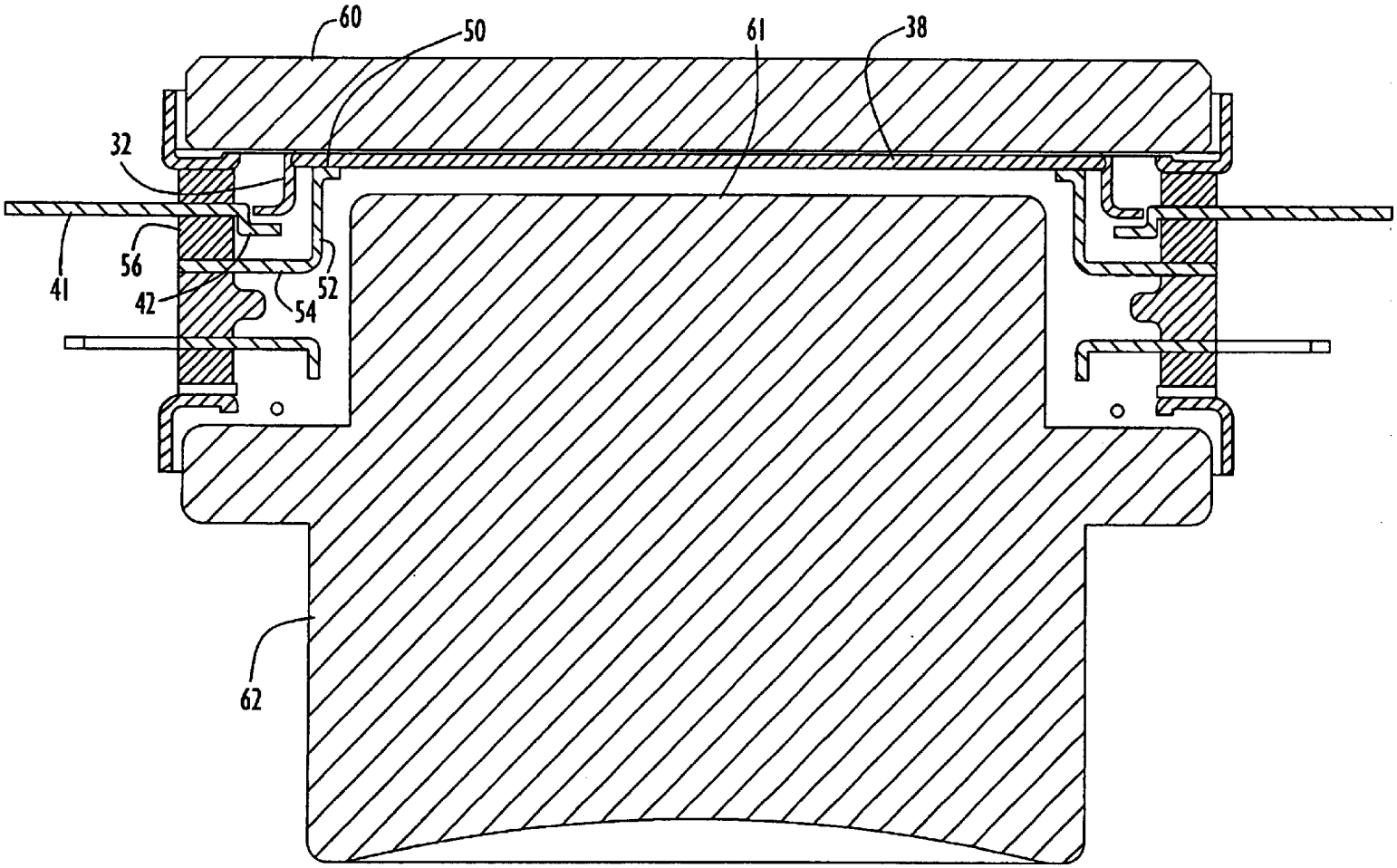
FIG. 7 shows the structure of FIG. 4 as mounted in a tube housing.
Figure 1:
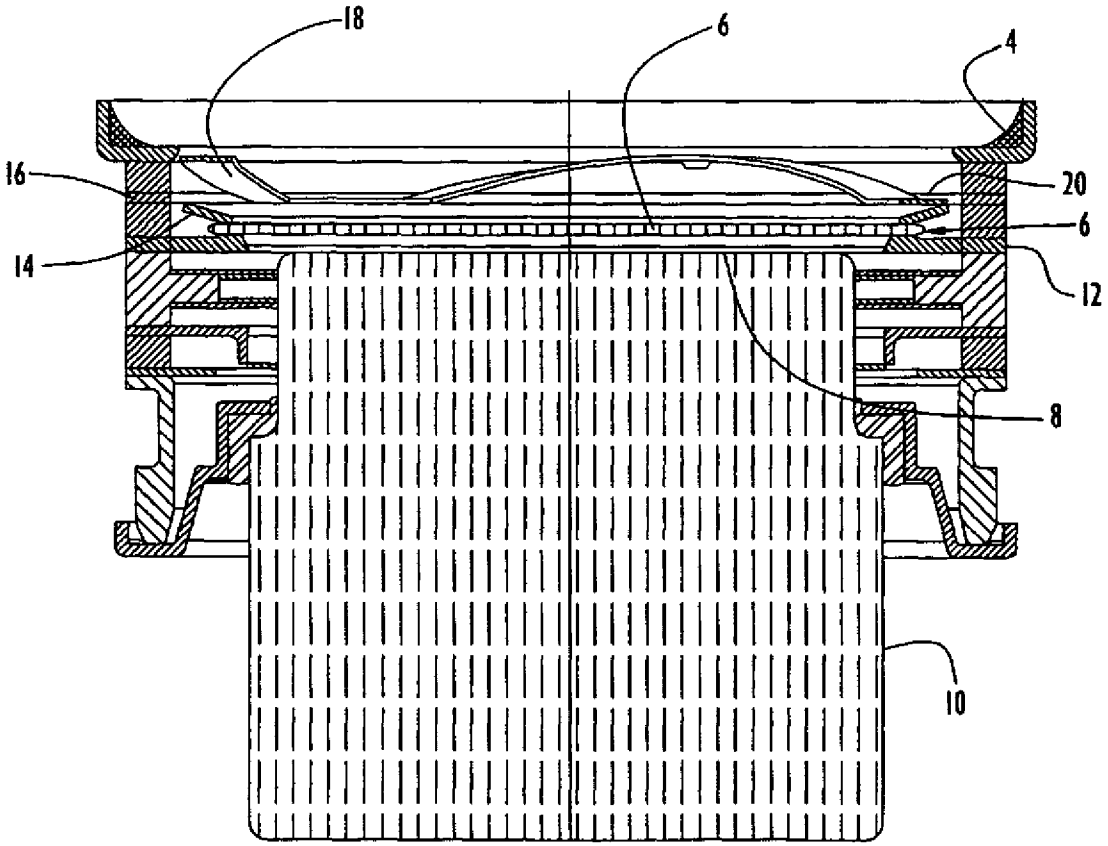
FIG. 1 PRIOR ART
Figure 2:
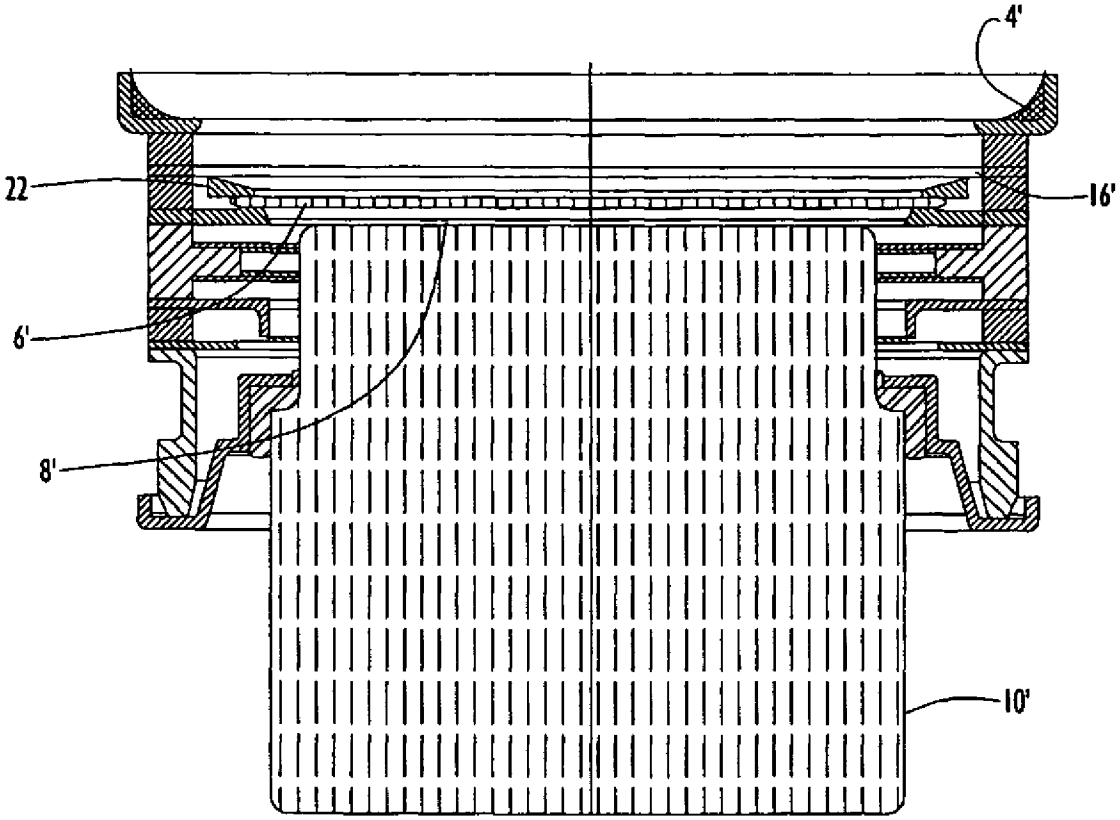
FIG.2 PRIOR ART
Figure 3:
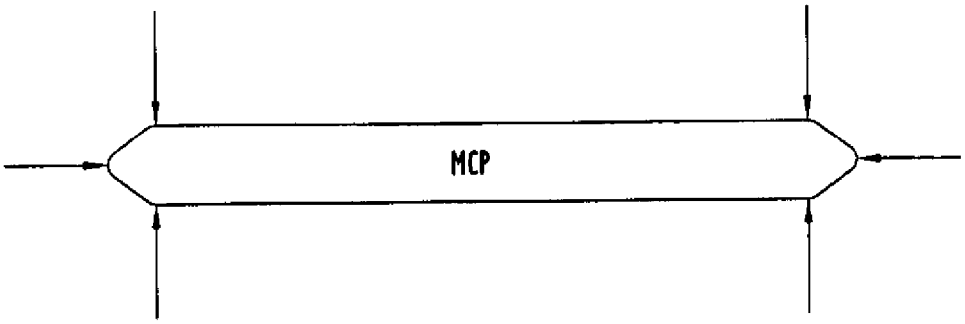
FIG.3 PRIOR ART
Figure 4:
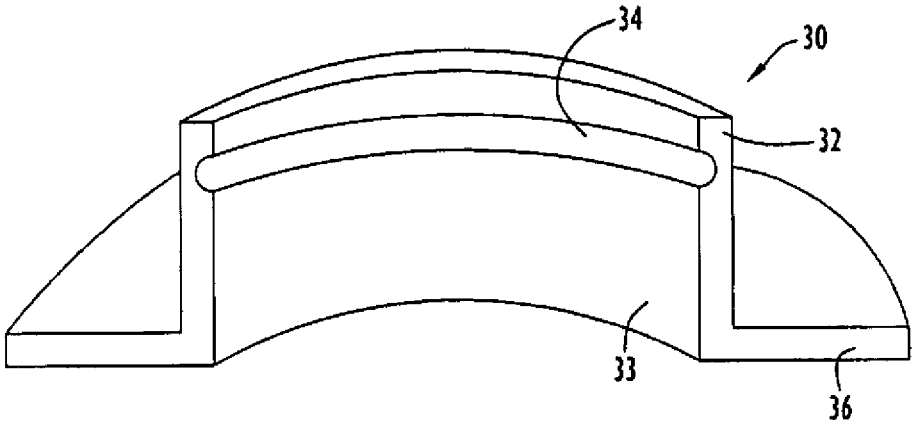
Figure 5:
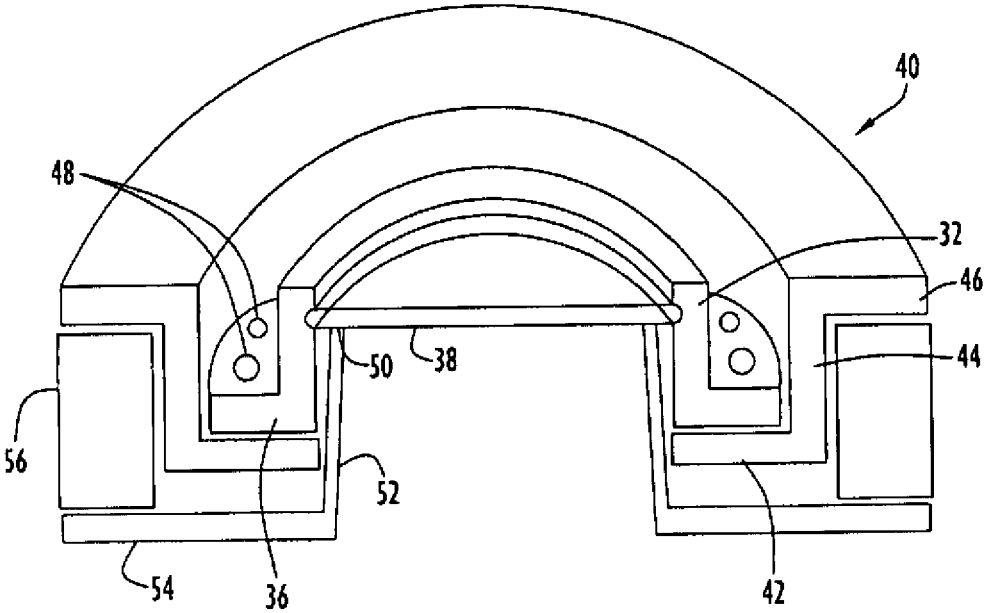
Figure 6:
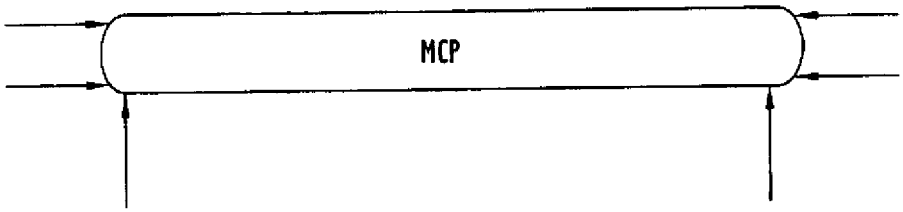
Figure 7:
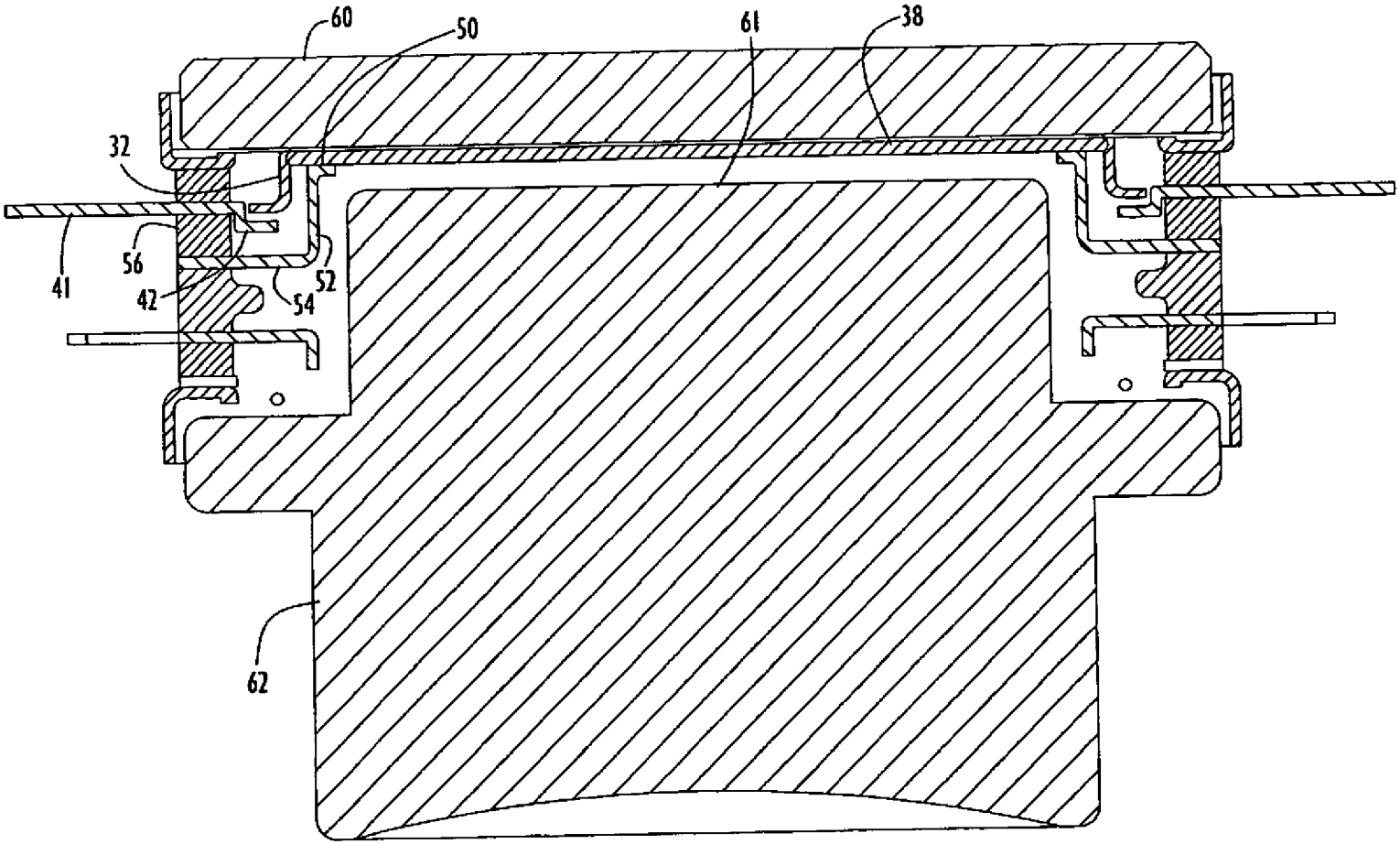

Peripheral retention member 40 is metallic, and it is comprised of annular platform 42, cylindrical member 44, and annular flange 46. The base 36 of the collar is correctly positioned on platform 42, and is secured thereto. Base 36 has holes 48, and the securing may be effected by welding the pieces together, where the welds are made in holes 48, thus fusing the two pieces. Alternatively, platform 42 may be provided with metallic tabs, which would extend through holes 48 and be bent over the base 36 to secure the two pieces together. In either case, since electrical contact is made between the collar and the peripheral retention means, a voltage for the MCP may be introduced via the part 41 of the peripheral retention means (FIG. 7). An advantage of the invention is a reduced rate of electrical evaporation, since contact is made on the periphery and not on the top.

FIG. 5 also shows MCP output contact support member 50,52,54, which supports the bottom of the MCP on surface 50 as well as ceramic ring 56. It is noted that while the components contact each other, for clarity of illustration, they are shown slightly separated.

FIG. 7 shows an image intensifier tube assembly which incorporates the invention. The tube assembly includes as the active components cathode 60, MCP 38, and screen 61 which is deposited on the top surface of fiber optic 62. The MCP is retained in the aforementioned recess in collar 32, while the base of the collar is secured to member 42 by welding or mechanical means. The MCP is also supported by MCP output contact support member 52,54, which has top support surface 50. This part also serves as a return path for current which passes through the MCP as a result of the potential difference across it. The metallic parts 40 and 54 are separated by ceramic ring 56 and the ceramic and metallic parts are brazed together, e.g., with a copper braze.

It will thus be appreciated that with the improved structure of the invention, no increase in the length of the tube is necessary for the securing of the MCP, and the diameter is also reduced. Additionally, there is a decrease in the number of body braze parts which are required.

The invention may be used in connection with the tube disclosed in U.S. Pat. No. 6,040,657 which has a thin photocathode, to provide a system having a shorter tube profile and smaller diameter. However, in general, the invention may be utilized in any type of image intensifier tube.

While the invention has been described in connection with an illustrative embodiment, variations which occur to those in the art are also encompassed herein, and the invention is defined in the claims which are appended hereto.

What is claimed is:

1. An image intensifier tube comprising a housing which holds a photocathode, a screen, and a microchannel plate, wherein a support for the microchannel plate comprises a one-piece longitudinally extending cylindrical collar in the housing having longitudinally extending interior and exterior cylindrical surfaces which are parallel to each other along the entire length of the exterior cylindrical surface, the interior cylindrical surface but not the exterior cylindrical surface having a cylindrical recess indented therein such that there are interior cylindrical portions on both sides of the recess and the microchannel plate is held in the recess, the cylindrical collar further having an annularly shaped base which extends radially from the external cylindrical surface for mounting the collar in the housing.

2. The image intensifier of claim 1 wherein the collar is supported in the housing by at least a peripheral retention member.

3. The image intensifier of claim 2 wherein the peripheral retention member has, a platform on which the base of the collar is secured, a second cylindrical member which is perpendicular to the platform and concentric with the first cylindrical member of the collar and an annular flange at the end of the second cylindrical member which extends in a direction away from the platform.

4. The image intensifier of claim 3 wherein the peripheral retention member is secured to the tube housing by the annular flange.

5. The image intensifier of claim 3 wherein the base of the collar is welded to the platform of the peripheral retention member.

6. The image intensifier of claim 3 wherein the base of the collar is secured to the platform of the peripheral retention member by locking tabs.

7. The image intensifier of claim 2 wherein the collar is further supported in the housing by an output contact support member located near the periphery of the microchannel plate on which the bottom of the microchannel plate rests.

8. The image intensifier of claim 7 wherein the output contact support member has a first surface parallel to the microchannel plate on which the bottom of the microchannel plate rests, a second portion perpendicular to the first surface which extends in a direction away from the microchannel plate, and a third portion parallel to the first surface which extends towards the outside of the tube.

9. The image intensifier of claim 8 wherein there is a ceramic ring between the flange of the peripheral retention member and the third portion of the output contact support member, which forms part of the tube housing.

10. The image intensifier of claim 1 wherein the longitudinally extending cylindrical collar has first and second ends, and wherein the base extends from the collar at a first end and the cylindrical recess is present near the second end.

11. The image intensifier of claim 10 wherein the totality of the length of the interior cylindrical portions on both sides of the recess is substantially greater than the thickness of the microchannel plate.

* * * * *

UNITED STATES PATENT AND TRADEMARK OFFICE

CERTIFICATE OF CORRECTION

PATENT NO. : 7,064,486 B1
APPLICATION NO. : 09/641685
DATED : June 20, 2006
INVENTOR(S) : Mabry It is certified that error appears in the above-identified patent and that said Letters Patent is hereby corrected as shown below:

The Title page, showing an illustrative figure, should be deleted and substitute therefor the attached Title page.

In the drawings, sheets 1 to 7, replace informal Figures 1 to 7 with Formal Figures 1 to 7 attached.

Signed and Sealed this

First Day of September, 2009

David J. Kappos

David J. Kappos
*Director of the United States Patent and Trademark Office*

(12) United States Patent
Mabry

(10) Patent No.: US 7,064,486 B1
(45) Date of Patent: Jun. 20, 2006

(54) LOCKING DEVICE FOR MICROCHANNEL PLATE IN IMAGE AMPLIFIER TUBE

(75) Inventor: Thomas Theodore Mabry, Roanoke, VA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 1190 days.

(21) Appl. No.: 09/641,685
(22) Filed: Aug. 18, 2000
(51) Int. Cl.
*H01J 31/50* (2006.01)

(52) U.S. Cl. ..... 313/544; 313/477 R; 313/524
(58) Field of Classification Search ..... 313/370, 313/534, 103 CM, 528, 544, 530, 116, 377, 313/379, 541, 105 CM
See application file for complete search history.

(56) References Cited

U.S. PATENT DOCUMENTS

| | | | | |
|---|---|---|---|---|
| 5,402,034 A | | 3/1995 | Blouch et al. | |
| 5,404,072 A | * | 4/1995 | Flanary et al. | 313/477 R |
| 6,040,657 A | | 3/2000 | Vrescak et al. | |

* cited by examiner

*Primary Examiner*—Vip Patel
*Assistant Examiner*—Ken Berck

(57) ABSTRACT

An image intensifier tube comprising a housing which holds a photocathode and a screen, wherein a microchannel plate is supported in a recess in an interior surface of an annular collar which is also held in the housing.

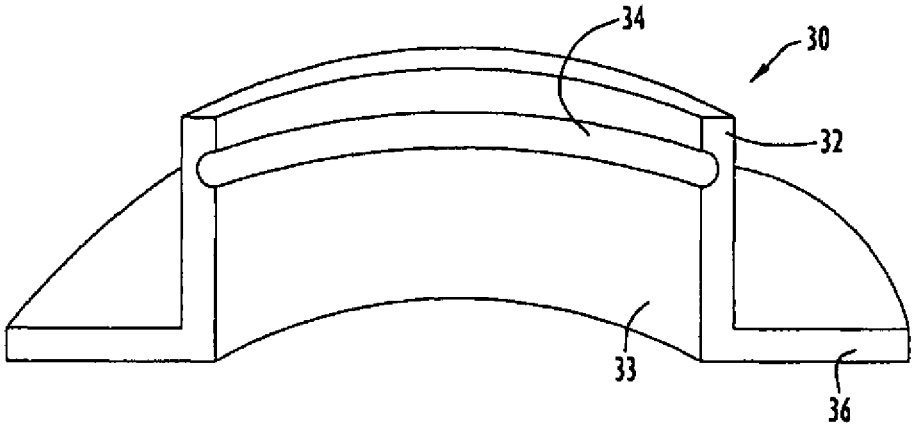

11 Claims, 5 Drawing Sheets